United States Patent [19]

Naik

[11] Patent Number: 4,528,128

[45] Date of Patent: Jul. 9, 1985

[54] DETERGENT COMPOSITIONS

[75] Inventor: Appaya R. Naik, Merseyside, England

[73] Assignee: Lever Brothers Company, New York, N.Y.

[21] Appl. No.: 567,709

[22] Filed: Jan. 3, 1984

[30] Foreign Application Priority Data

Jan. 21, 1983 [GB] United Kingdom ..... 8301745

[51] Int. Cl.[3] ..... C11D 1/12

[52] U.S. Cl. ..... 252/549; 252/554; 252/556; 252/559; 252/538; 252/DIG. 14

[58] Field of Search ..... 560/151; 252/544, 546, 252/549, 554, 556, 557, 559, DIG. 14, 538

[56] References Cited

U.S. PATENT DOCUMENTS 2,028,091 1/1936 Jaeger ..... 260/106
2,813,078 12/1957 Vitalis ..... 252/161
4,072,632 2/1978 Reed ..... 252/541
4,434,090 2/1984 Hampson et al. ..... 252/551

FOREIGN PATENT DOCUMENTS 2105325 3/1983 United Kingdom .
2108520 4/1983 United Kingdom .

OTHER PUBLICATIONS

I. G. Reznikov, Maslob.-Zhirov. Prom., 1970, No. 10, pp. 26-29, (translation supplied).

*Primary Examiner*—Paul Lieberman
*Assistant Examiner*—Hoa Van Le
*Attorney, Agent, or Firm*—Milton L. Honig; James J. Farrell

[57] ABSTRACT

Detergent compositions suitable inter alia for hand dishwashing include as active detergent a mixture of dialkyl sulphosuccinates obtained from a mixture of $C_7$ and $C_8$ aliphatic alcohols, optionally with $C_6$ alcohol. Improved performance and formulation benefits are obtained.

18 Claims, No Drawings

DETERGENT COMPOSITIONS

The present invention relates to certain detergent-active dialkyl sulphosuccinates and to their use in detergent compositions suitable for many purposes, for example, fabric washing products, general purpose domestic and industrial cleaning compositions, shampoos, foam bath products, and, above all, compositions for use in manual dishwashing operations in both hard and soft water. The invention relates more especially, but not exclusively, to liquid detergent compositions.

The term "dishes" as used herein means any utensils involved in food preparation or consumption which may be required to be washed to free them from food particles and other food residues, greases, proteins, starches, gums, dyes, oils and burnt organic residues.

The present invention is based on the observation that in detergent compositions based on dialkyl sulphosuccinates the foaming performance is enhanced by the selection of particular combinations of dialkyl sulphosuccinates of particular chain lengths. These combinations also give formulation benefits (viscosity, cloud point) in liquid compositions.

The dialkyl sulphosuccinates are compounds of the formula I:

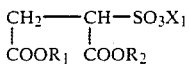

$$\begin{array}{l} CH_2 — CH — SO_3X_1 \\ \quad | \qquad\quad | \\ COOR_1 \quad COOR_2 \end{array} \qquad (I)$$

wherein each of $R_1$ and $R_2$, which may be the same or different, represents a straight-chain or branched-chain alkyl group, and $X_1$ is a cation. Compounds in which the R groups have from 3 to 12 carbon atoms generally exhibit surface activity, provided that $X_1$ is a solubilising cation, for example, alkali metal, ammonium, substituted ammonium or magnesium. Dialkyl sulphosuccinates are generally prepared by esterifying maleic anhydride (or maleic acid or fumaric acid, but preferably maleic anhydride) with an appropriate alcohol, to give a dialkyl maleate/fumarate, which is then subjected to bisulphite addition to give the dialkyl sulphosuccinate.

Esterification of maleic anhydride with a single alcohol gives a single product in which both alkyl groups are the same. If, however, a mixture of two different alcohols is used, a mixture of the two possible symmetrical sulphosuccinates together with the unsymmetrical material having two different alkyl group is obtained. There are various disclosures in the art on the use of dialkyl sulphosuccinates prepared from mixed alcohols.

GB No. 1 429 637 (Unilever) discloses hand dishwashing compositions containing a water-soluble salt of a di($C_7$–$C_9$) alkyl ester of sulphosuccinic acid, in combination with an alkyl sulphate or an alkyl ether sulphate. In one Example, the dialkyl sulphosuccinate used is derived from Linevol (Trade Mark) 79 ex Shell, which at the date of publication of the said GB No. 1 429 637 consisted of a mixture of $C_7$, $C_8$ and $C_9$ alcohols produced by the OXO process from a mixture of cracked-wax olefins, the proportions being approximately 40 mole % $C_7$, 40 mole % $C_8$ and 20 mole % $C_9$.

GB No. 2 105 325 (Unilever) describes and claims the unsymmetrical material hexyl octyl sulphosuccinate. GB No. 2 108 520 (Unilever) describes and claims dialkyl sulphosuccinate mixtures containing as essential constituents a di($C_7$–$C_9$) alkyl sulphosuccinate together with an unsymmetrical ($C_7$–$C_9$) ($C_3$–$C_6$) alkyl sulphosuccinate.

I G Reznikov et al, Maslob.-Zhirov. Prom., 1970, No 10, pages 26–29, disclose a dialkyl sulphosuccinate mixture derived from a particular mixture of straight-chain primary alcohols produced in a particular synthetic fatty acid plant in the Soviet Union. The chain length distribution of the alcohol mix was (by weight) $C_7$ 2.0%, $C_8$ 13.1%, $C_9$ 31.8%, $C_{10}$ 40.1% and $C_{11}$ 13%.

The present invention is based on the discovery that optimum foaming properties are obtained using a dialkyl sulphosuccinate mixture derived from a mixed alcohol system consisting wholly or predominantly of $C_7$ and $C_8$ material, optionally with minor amounts of $C_6$ material but substantially free of other chain lengths. Surprisingly, the mixture obtained from a $C_7/C_8$ alcohol mix, and thus containing the unsymmetrical $C_7/C_8$ sulphosuccinate, has a substantially better foaming performance than does a simple mixture of diheptyl and dioctyl sulphosuccinates. In liquid detergent compositions, greatly improved physical characteristics are also obtained.

Accordingly the present invention provides a detergent-active dialkyl sulphosuccinate mixture derived from a mixture of straight-chain and/or 2-branched, preferably primary, aliphatic alcohols comprising (a) 25 to 75 mole % of $C_8$ alcohol, (b) 15 to 75 mole % of $C_7$ alcohol, and (c) 0 to 35 mole % of $C_6$ alcohol, said alcohol mix being substantially free of material of other chain lengths.

The invention further provides a foaming detergent composition comprising at least 2% by weight of the dialkyl sulphosuccinate mix defined above, in conjunction with other conventional constituents of detergent compositions, but free of other dialkyl sulphosuccinates.

According to a preferred embodiment, the foaming detergent composition of the invention is a liquid containing at least 2% of an active detergent mixture consisting wholly or partially of the dialkyl sulphosuccinate mix. If the total level of active detergent is only 2%, clearly it will then consist entirely of the dialkyl sulphosuccinate mix, but at higher active detergent levels other active detergents may additionally be present.

The liquid detergent composition of the invention will generally be in the form of a stable aqueous solution or dispersion, and is preferably a clear homogeneous solution. Although in principle the concentration of the active detergent mixture in such a composition may be as high as desired, provided that a stable aqueous solution can be obtained, it is preferably within the 2 to 60% by weight range and more preferably within the 5 to 40% by weight range.

The invention is of especial interest in the context of unbuilt light-duty foaming liquid compositions suitable for hand dishwashing.

The dialkyl sulphosuccinate mix of the invention is derived from a mixture of $C_8$, $C_7$ and optionally $C_6$ aliphatic alcohols in particular molar proportions. The synthesis of dialkyl sulphosuccinates from aliphatic alcohols is well documented in the literature; see, for example, U.S. Pat. No. 2,028,091 (American Cyanamid) and the aforementioned GB Nos. 2 105 325 and 2 108 520 (Unilever). As mentioned, above, a suitable sythetic method involves the esterification of maleic anhydride, maleic acid or fumaric acid with the alcohol mixture to give dialkyl maleate and/or fumarate, followed by reaction with a sulphite-ion-generating compound to effect bisulphite addition.

If a mixture of $C_7$ and $C_8$ alcohols is used, the resulting mixture of diesters will contain the symmetrical $diC_7$ and $diC_8$ materials and the unsymmetrical $C_7/C_8$ material. When the starting alcohols are used in substantially equimolar proportions, about 25 mole % each of the two symmetrical diesters and about 50 mole % of the unsymmetrical diester will be obtained. When $C_6$ alcohol is also present in the starting alcohol mix, the $diC_6$, $C_6/C_7$ and $C_6/C_8$ diesters will of course also be formed.

According to the present invention, at least 65 mole % of the starting alcohol mix is constituted by $C_7$ and $C_8$ alcohols, the balance, if any, being constituted by $C_6$ alcohol. Preferably the total amount of $C_7$ and $C_8$ alcohols is at least 75 mole %.

The presence of $C_6$ material in the amounts defined above can be beneficial with respect to hard water performance; in larger quantities it can be detrimental in terms of soft water performance. In liquid compositions the presence of $C_6$ material aids formulation in that it lowers cloud points and hydrotrope requirements, but in large quantities it can give rise to the problem of low viscosity, which may be unattractive to the consumer in some markets. High viscosities give increased freedom to the formulator, since viscosity can easily be reduced by the addition of ethanol but is not so easily increased, and are therefore generally advantageous.

In comparison with the $C_6/C_8$ mixed dialkyl sulphosuccinate systems disclosed in the aforementioned GB No. 2 108 520, the $C_7/C_8$ and $C_6/C_7/C_8$ systems of the present invention give improved foaming performance in both hard and soft water, and enable liquid formulations of considerably higher viscosity to be prepared.

An optimum balance of foaming properties and detergency in both hard and soft water is obtained from dialkyl sulphosuccinate mixes derived from alcohol mixes in which the mole ratio of $C_8$ alcohol to $C_7$ and, if present, $C_6$ alcohol is within the range of from 3:1 to 1:3, more preferably 2:1 to 1:2. The ratio of $C_8$ alcohol to $C_7$ alcohol is also preferably within the range of from 3:1 to 1:3, preferably from 2:1 to 1:2.

The dialkyl sulphosuccinate mix of the invention is substantially free of material having alkyl chain lengths other than $C_6$, $C_7$ or $C_8$.

The foaming performance of $C_9$ and longer-chain dialkyl sulphosuccinates is poor, especially in hard water, and becomes poorer as the chain length increases. They are also detrimental in terms of formulating liquid products. When $C_9$ material is present hydrotrope requirements are increased, and even with relatively large amounts of hydrotrope present it becomes difficult to formulate a clear, stable product as demonstrated by an acceptably low cloud point. $C_{10}$ and longer-chain materials would be expected to cause even greater problems.

$C_5$ and shorter-chain materials are virtually ineffective in terms of foaming performance, and in liquid products would be expected to give rise to very low viscosities.

Accordingly these longer- and shorter chain dialkyl sulphosuccinates are excluded from the mixtures of the invention.

The $C_6$, $C_7$ and $C_8$ alcohols from which the alkyl chains in the dialkyl sulphosuccinates of the invention originate are preferably primary alcohols and may, as already indicated, be either straight-chain or branched at the 2-position; straight-chain material preferably predominates. The alcohols manufactured by the OXO process, and consisting predominantly of linear material together with 2-methyl-branched material and lesser amounts of 2-ethyl and higher-branched material, are suitable for use in the preparation of the dialkyl sulphosuccinate mix of the invention, as are wholly linear alcohols.

Detergent compositions of the invention contain at least 2%, preferably at least 5% and more preferably at least 10%, of the dialkyl sulphosuccinate mix. If desired, other detergent-active agents may also be present. These are preferably anionic or nonionic, but may also be cationic, amphoteric or zwitterionic. The type of detergent-active material present in addition to the dialkyl sulphosuccinate mixture of the invention will depend on the intended end-use of the product. The weight ratio of total dialkyl sulphosuccinate to other detergent-active material may range, for example, from 99:1 to 1:49; the dialkyl sulphosuccinate is, however, preferably the predominant detergent-active component.

In foaming liquid compositions intended for hand dishwashing, the dialkyl sulphosuccinate may suitably be combined with other appropriate anionic or nonionic detergents. For example, the composition of the invention may, if desired, additionally include one or more of the sulphonate-type detergents conventionally used as the main detergent-active agent in liquid compositions, for example, alkylbenzene sulphonates (especially $C_9$–$C_{15}$ linear alkyl benzene sulphonates), secondary alkane sulphonates, alpha-olefin sulphonates, alkyl glyceryl ether sulphonates, and fatty acid ester sulphonates. Of course dialkyl sulphosuccinates are themselves sulphonate-type detergents. If such additional sulphonate-type materials are present, the total sulphonate preferably predominates in the active detergent mixture of the composition of the invention.

If desired there may also be present one or more primary or secondary alkyl sulphates. If present, these together with any sulphonate material as mentioned above, including the dialkyl sulphosuccinate mixture, preferably predominate in the active detergent mixture of the composition of the invention.

Liquid compositions of the invention may advantageously contain one or more further detergent-active materials in addition to the dialkyl sulphosuccinate mixture and optional additional sulphonate and/or alkyl sulphate already mentioned. Preferably there are present one or more alkyl ether sulphates and/or one or more polyethoxylated nonionic detergents.

Preferred alkyl ether sulphates are material of the general formula:

$$R_3—O—(CH_2CH_2O)_n—SO_3X_2$$

wherein $R_3$ is a $C_{10}$ to $C_{18}$ alkyl group, $X_2$ is a solubilising cation, and n, the average degree of ethoxylation, is from 1 to 12, preferably 1 to 8. $R_3$ is preferably a $C_{11}$ to $C_{15}$ alkyl group. In any given alkyl ether sulphate, a range of differently ethoxylated materials, and some unethoxylated material, will be present and the value of n represents an average. The unethoxylated material is, of course, alkyl sulphate. If desired, additional alkyl sulphate may be admixed with the alkyl ether sulphate, to give a mixture in which the ethoxylation distribution is more weighted towards lower values.

It is especially preferred, according to the present invention, to use primary alkyl ether sulphates containing less than 20% by weight of $C_{14}$ and above material, as described and claimed in our British Patent Application No. 82 32686 filed on 16 Nov. 1982. Such material preferably has a degree of ethoxylation of 1 to 8.

Examples of preferred ether sulphates for use in the present invention are Dobanol (Trade Mark) 23-2, 23-3 and 23-6.5 ex Shell, all based on $C_{12}$–$C_{13}$ (50% of each) primary alcohol (about 75% straight-chain, 25% 2-methyl branched), and having average degrees of ethoxylation n of 2, 3 and 6.5 respectively.

The alkyl ether sulphate advantageously used in the composition of the invention may if desired be supplemented or replaced by a polyethoxylated nonionic detergent having an alkyl chain length of from $C_8$ to $C_{15}$ and an average degree of ethoxylation of from 5 to 14. Suitable nonionic detergents include short-chain high-foaming ethoxylated alcohols of the general formula III:

$$R_4—O—(CH_2CH_2O)_m—H \quad \text{(III)}$$

wherein $R_4$ is an alkyl group, preferably straight-chain, having from 8 to 13 carbon atoms, and the average degree of ethoxylation m is from 5 to 12. An example of such a nonionic detergent is Dobanol 91-8 ex Shell ($R_4$ is $C_9$–$C_{11}$, m is 8).

Another class of nonionic detergents of interest is constituted by the alkylphenol polyethers of the general formula IV.

$$R_5—C_6H_4—O(CH_2CH_2O)_xH \quad \text{(IV)}$$

wherein $R_5$ is an alkyl group having from 6 to 16 carbon atoms, preferably 8 to 12 carbon atoms, and the average degree of ethoxylation x is from 8 to 16, preferably from 9 to 12. An example of such a nonionic detergent is Nonidet (Trade Mark) P.80 ex Shell ($R_5$ is $C_8$, x is 11).

The ratio of dialkyl sulphosuccinate, plus any other sulphonate-type detergent present plus any alkyl sulphate present other than that intrinsically present in ether sulphates, to ether sulphate and/or nonionic detergent is preferably within the range of from 5:1 to 0.5:1, more preferably from 3:1 to 1:1.

If desired the compositions of the invention may also include a $C_{10}$–$C_{18}$ carboxylic acid di($C_2$–$C_3$) alkanolamide, as described and claimed in our British Patent Application No. 82 32688 filed on 16 Nov. 1982. These are materials of the general formula V:

$$R_6—CO—N(R_7)_2 \quad \text{(V)}$$

wherein $R_6$ is a $C_{10}$–$C_{18}$ aliphatic group, preferably straight-chain and preferably saturated, and $R_7$ is a hydroxyethyl or hydroxypropyl group. $R_7$ is preferably a 2-hydroxyethyl group. The radical $R_6$ is generally of natural origin and materials of this type thus contain a range of molecules having $R_6$ groups of different chain lengths; for example, coconut diethanolamides consist predominantly of $C_{12}$ and $C_{14}$ material, with varying amounts of $C_8$, $C_{10}$ and $C_{16}$ material.

Suitable materials of this class include Empilan (Trade Mark) LDE and CDE ex Albright and Wilson, and Ninol (Trade Mark) P-621 and AA-62 Extra ex Stepan Chemical Co.

Inclusion of a dialkanolamide can improve foaming performance and also reduce the hydrotrope requirements of liquid products. The amount of dialkanolamide present should not, however, exceed 30% by weight of the total active detergent mixture, and preferably does not exceed 25% by weight.

Other detergent-active materials of lesser interest that may nevertheless be included in minor amounts in the compositions of the invention include alcohol and alkylphenol propoxylates, ethoxylated and propoxylated fatty acid amides, amine oxides, betaines and sulphobetaines.

As well as active detergent and water, liquid compositions according to the invention will generally need to contain one or more hydrotropes. Hydrotropes are materials present in a formulation to control solubility, viscosity, clarity and stability, but which themselves make no active contribution to the performance of the product. Examples of hydrotropes include lower aliphatic alcohols, especially ethanol; urea; lower alkylbenzene sulphonates such as sodium toluene and xylene sulphonates; and combinations of these. Urea is the preferred hydrotrope in the compositions of the invention.

The compositions of the invention may also contain the usual minor ingredients such as perfume, colour, preservatives and germicides.

The foregoing discussion is of particular relevance to liquid compositions intended for hand dishwashing, but it should be understood that these liquid compositions may also be suitable for other cleaning applications, and that detergent compositions of other physical forms, for example, powders, solid bars or gels, are also within the scope of the invention. Compositions according to the invention may be used for any type of detergent product, for example, fabric washing compositions, general purpose domestic and industrial cleaning compositions, carpet shampoos, car wash products, personal washing products, shampoos, foam bath products, and machine dishwashing compositions.

The invention is further illustrated by the following non-limiting Examples.

EXAMPLE I

(i) Preparation of statistical mixture of $C_7/C_8$ maleates/fumarates

Maleic anhydride (98 g, 1.0 mole) in toluene (400 ml) containing octan-1-ol (130 g, 1.0 mole) and heptan-1-ol (116 g, 1.0 mole) and p-toluene sulphonic acid (2 g) was stirred under reflux for 3 h. Water was removed azeotropically by means of a Dean & Stark apparatus (approximately 18 ml, i.e. 1 mole, of water were collected). The crude reaction mixture was cooled and washed with 30% sodium hydroxide solution, then water, then brine, before drying over anhydrous magnesium sulphate. The mixture was filtered and the solvents removed in vacuo to yield an oil (293 g).

This oil was shown by gas-liquid chromatography to consist of the symmetrical di$C_8$ diester, the unsymmetrical $C_7/C_8$ diester and the symmetrical di$C_7$ diester in molar proportions of approximately 1:2:1.

(ii) Preparation of statistical mixture of $C_7/C_8$ sulphosuccinates

The oil prepared in the previous experiment, without further purification, was dissolved in industrial methylated spirit (500 ml) and refluxed with water (400 ml) containing sodium metabisulphite (190 g, 1.0 mole) for 6 hours. The solvent was removed in vacuo to yield a crude solid which was taken up in hot ethanol and filtered. The ethanol was removed under reduced pressure to give ca 340 g of a solid, which was shown to consist of about 94.5% detergent-active material and 0.17% non-detergent organic matter. By high-performance liquid chromatography it was shown to consist of the $diC_8$, $C_7/C_8$ and $diC_7$ dialkyl sulphosuccinate in molar proportions of approximately 1:2:1.

EXAMPLES II–XIV

In the following Examples the foaming performances and physical properties of various liquid detergent compositions containing dialkyl sulphosuccinate mixes in accordance with the invention were measured and compared with those of various compositions outside the invention. In each Example the dialkyl sulphosuccinate mix is specified by the molar proportions of the various chain length alcohols in the starting alcohol mix. The mixes were prepared as described in Example I but using the stated molar ratios of the starting alcohols. The $C_9$ and $C_6$ alcohols used were nonan-1-ol and hexan-1-ol respectively.

The compositions also contained alkyl ether sulphate (Dobanol 23-3A ex Shell; $C_{12}$–$C_{13}$, n=3, ammonium salt). Urea was used as hydrotrope.

Foaming performances were compared by means of a plate washing test, in which plates soiled with a standard starch/fat/fatty acid mixture were washed in a standard manner with 5 liters of test solution (total concentration of the product 1 g/liter in 5°H or 24°H (French hardness) water at 45° C.) in a bowl, until only a third of the surface of the solution in the bowl was covered with foam. The number of plates washed before this arbitrary end-point was reached was taken as an indicator of dishwashing and foaming performance.

The absolute number of plates washed by a particular composition is sensitive to the energy input of the operator and will therefore vary strongly from one operator to another and even, to a lesser extent, from one occasion to another when using the same operator. The proportional differences between the results obtained using different compositions tested on the same occasion by the same operator are, however, substantially independent of operator and occasion. Accordingly, the results that follow have been normalised, using Composition 1 of Example II (see below) as a standard, so that comparisons between different sets of results could be made.

Viscosities were measured using an Ostwald capillary tube or a Haake viscometer. Urea was used as a hydrotrope in order to attain acceptable low temperature stability as demonstrated by cloud points sufficiently below room temperature.

In the Examples, compositions according to the invention are identified by numerals while those outside the invention are identified by letters.

EXAMPLE II

This Example shows the performance advantage of a $C_7/C_8$ dialkyl sulphosuccinate mix according to the invention, derived from mixed alcohols (50 mole % of each) as described in Example I, as compared with a 1:1 molar mixture of $diC_7$ and $diC_8$ sulphosuccinates each prepared from a single alcohol. All the dialkyl sulphosuccinates used in this Example were derived from straight chain primary alcohols. Each composition contained 16% by weight (in total) of dialkyl sulphosuccinate and 8% by weight of alkyl ether sulphate (Dobanol 23-3A).

| | Composition | |
|---|---|---|
| | 1 | A |
| Dialkyl sulphosuccinate (by starting alcohol) (wt %) | | |
| n-$C_7$ | | 8 |
| n-$C_8$ | | 8 |
| n-$C_7$ + n-$C_8$ (1:1) | 16 | |
| Alkyl ether sulphate | 8 | 8 |
| Plates test 24° H | 37 | 26 |
| 5° H | 55 | 45 |

The improved performance in both hard and soft water will be noted.

In a different test it was shown that the mixture used in Composition A above itself performs better than corresponding compositions containing the di-n-heptyl or di-n-octyl materials alone, the former being poor in soft water and the latter being poor in hard water. The test method used in this case was a modified Schlachter-Dierkes test based on the principle described in Fette und Seifen 1951, 53, 207. A 100 ml aqueous solution of each material tested, having a concentration of 1 g/liter of the total product, in 5°H or 24°H water at 45° C., was rapidly oscillated using a vertically oscillating perforated disc within a graduated cylinder. After the initial generation of foam, increments (0.2 g) of soil (9.5 parts commercial cooking fat, 0.25 parts oleic acid, 0.25 parts stearic acid and 10 parts wheat starch in 120 parts water) were added at 15-second intervals (10 seconds' mild agitation and 5 seconds' rest) until the foam collapsed. The result was recorded as the number of soil increments (NSI score): a score difference of 6 or less is generally regarded as insignificant. Each result was typically the average of three or four runs.

| | Composition | | | | |
|---|---|---|---|---|---|
| | A | B | C | D | E |
| Dialkyl sulphosuccinate (by starting alcohol (wt %) | | | | | |
| n-$C_7$ | 8 | 10 | 20 | | |
| n-$C_8$ | 8 | 10 | | 20 | 16 |
| Alkyl ether sulphate (wt %) | 8 | 5 | 5 | 5 | 8 |
| NSI score 24° H | 42 | 39 | 39 | 22 | 25 |
| 5° H | 36 | 36 | 15 | 38 | 38 |

EXAMPLE III

In this Example a dialkyl sulphosuccinate mix containing some branched-chain material was compared with the similar, but wholly straight-chain, mix used in Example II. The branched-chain alcohol concerned was a $C_7$ alcohol containing approximately 50% heptan-1-ol and approximately 50% 2-methylhexan-1-ol.

Each composition contained 16% by weight of dialkyl sulphosuccinate, 8% by weight of alkyl ether sulphate (Dobanol 23-3A) and 15% by weight of urea. The alkyl ether sulphate was in the form of a 60% solution containing 14% ethanol, but the figure of 8% given above represents the actual (100%) alkyl ether sulphate; the compositions thus contained about 2% ethanol.

| | Dialkyl sulphosuccinate (mole % of starting alcohol) | | | Cloud point | Viscosity | Plates test | |
|---|---|---|---|---|---|---|---|
| | n-$C_7$ | $C_7$(br.) | n-$C_8$ | (°C.) | (cp) | 5° H | 24° H |
| 1 | 50 | — | 50 | 5 | 295 | 55 | 37 |
| 2 | — | 50 | 50 | −8 | 255 | 54 | 42 |

It will be seen that use of the partially branched-chain material gave a lower cloud point; the cloud point of Composition 1 could be brought below 0° C. by the addition of further urea. There was also a slight improvement in hard water performance.

EXAMPLE IV

In this Example the effect of varying the mole ratio of $C_7$ and $C_8$ starting alcohols was investigated. Both alcohols were straight-chain. Again the compositions contained 16% dialkyl sulphosuccinate and 8% alkyl ether sulphate (Dobanol 23-3A). This latter material, unlike the alkyl ether sulphate used in the previous Example, was substantially free of ethanol, hence the higher viscosities.

| | $C_7$ | $C_8$ | Urea (wt %) | Cloud point (°C.) | Viscosity (cp) | Plates test 5° H | Plates test 24° H |
|---|---|---|---|---|---|---|---|
| 3 | 75 | 25 | 16 | −3 | 270 | 45 | 36 |
| 4 | 50 | 50 | 16 | −5 | 501 | 55 | 37 |
| 5 | 25 | 75 | 18 | 10 | 595 | 50 | 28 |

Composition 4, containing the same 50:50 $C_7/C_8$ dialkyl sulphosuccinate mix as Composition 1 of Example II, gave the best performance in both hard and soft water. Composition 5 also had a high viscosity but its hard water performance was inferior, and its cloud point high despite a higher urea content. Composition 3 showed some fall-off in soft water performance and its viscosity was lower. Thus the 50:50 material appears to offer the best combination of properties.

EXAMPLE V

The procedure of Example IV was repeated using compositions containing 12% by weight of dialkyl sulphosuccinate and 12% by weight of alkyl ether sulphate (containing ethanol as in Example III).

| | $C_7$ | $C_8$ | Urea (wt %) | Cloud point (°C.) | Viscosity (cp) | Plates test 5° H | Plates test 24° H |
|---|---|---|---|---|---|---|---|
| 6 | 75 | 25 | 5 | −7 | 263 | 30 | 35 |
| 7 | 50 | 50 | 5 | 1 | 559 | 38 | 36 |
| 8 | 25 | 75 | 5 | 12 | 741 | 45 | 30 |
| | | | 8 | −4 | | | |

Again the 50:50 material offers the best compromise on performance. Composition 8, high in $C_8$ material, had a good viscosity and soft water performance, but its hard water performance was not optimum and it required 8% urea to bring the cloud point below 0° C. Composition 6, high in $C_7$ material, had an excellent cloud point but rather low viscosity and soft water performance.

Thus similar trends can be seen to those of Example IV. All three ratios give good compositions, but it is evident that, when no $C_6$ material is present, the proportion of $C_8$ material in the starting alcohol mix should not exceed 75 mole %, for optimum hard water performance and hydrotroping, and that the proportion of $C_7$ material in the starting alcohol mix should not exceed 75 mole % for optimum soft water performance and viscosity. The effect of $C_6$ material will be explored in Examples VII to XIV.

EXAMPLE VI

This Example demonstrates the detrimental effect of $C_9$ material in the dialkyl sulphosuccinate mix. The compositions contained 16% by weight of dialkyl sulphosuccinate, 8% by weight of alkyl ether sulphate (ethanol-free) and varying amounts of urea as shown. The dialkyl sulphosuccinates were all derived from linear alcohols.

| | $C_7$ | $C_8$ | $C_9$ | Urea (wt %) | Cloud point (°C.) | Viscosity (cp) | Plates test 5° H | Plates test 24° H |
|---|---|---|---|---|---|---|---|---|
| 4 | 50 | 50 | — | 16 | −5 | 501 | 55 | 37 |
| F | 45 | 45 | 10 | 18 | 10 | 527 | 52 | 26 |
| G | 40 | 40 | 20 | 18 | 12 | 728 | 45 | 24 |

The dramatic drop in hard water performance caused by the inclusion of as little as 10 mole % of $C_9$ alcohol in the starting alcohol mix will be noted. Soft water performance also deteriorated, especially at the higher $C_9$ level of 20 mole %. The cloud point also rose well above 0° C. even at the higher urea level of 18%.

EXAMPLE VII

In this Example some dialkyl sulphosuccinate mixes derived from ternary ($C_6/C_7/C_8$) alcohol mixes were investigated. All three alcohols used to prepare the dialkyl sulphosuccinates were linear. The compositions all contained 16% dialkyl sulphosuccinate and 8% ethanol-free alkyl ether sulphate.

In the first set of results (Compositions 9 to 11) the ratio of $C_8$ to $C_7$ alcohol in the starting mix was 2:1.

| | $C_6$ | $C_7$ | $C_8$ | Urea (wt %) | Cloud point (°C.) | Viscosity (cp) | Plates test 5° H | Plates test 24° H |
|---|---|---|---|---|---|---|---|---|
| 9 | 10 | 30 | 60 | 16 | −7 | 507 | 49 | 28 |
| 10 | 25 | 25 | 50 | 12 | 10 | 350 | 43 | 36 |
| | | | | 14 | −6 | | | |
| H | 50 | 16.7 | 33.3 | 12 | −8 | 119 | 30 | 28 |
| 4 | — | 50 | 50 | 16 | −5 | 501 | 55 | 37 |
| 11 | 20 | 40 | 40 | 14 | 1 | 320 | 43 | 36 |
| J | 50 | 25 | 25 | 12 | <−10 | 101 | 26 | 26 |
| 12 | 10 | 60 | 30 | 12 | −4 | 332 | 45 | 36 |
| 13 | 25 | 50 | 25 | 12 | −9 | 195 | 35 | 32 |

Composition 9, containing dialkyl sulphosuccinate derived from an alcohol mix containing 10 mole % of $C_6$ alcohol, had a high viscosity and good soft water performance, but its hydrotrope requirement was rather high and its hard water performance was not optimum. A higher level of $C_6$ material (25 mole %) improved the cloud point and hydrotrope requirement, and the hard water performance was regained. At the still higher level of 50%, however, the performance and viscosity had both fallen to an undesirable level and clearly the addition of higher levels of $C_6$ material would be detrimental.

In the second set of results (Compositions 4, 11 and J) the $C_8$:$C_7$ ratio was 1:1, and a direct comparison with a system containing no $C_6$ alcohol (Composition 4) could be made. Inclusion of 20 mole % of $C_6$ alcohol lowered the hydrotrope requirement and the viscosity: the hard water performance was unaffected, but the soft water performance was slightly worse. A level of 50 mole % of $C_6$ alcohol (Composition J) was, however, clearly too high and the performance and viscosity had fallen below an acceptable level.

In the third set of results the $C_8$:$C_7$ ratio was 2:1. At the 10% $C_6$ level (Composition 12) the hydrotrope requirement was modest and viscosity and performance were both good. The beginning of a fall-off in both viscosity and performance could be observed at the 25% $C_6$ level (Composition 13). In view of the behaviour of Composition H the 50% $C_6$ level at this $C_8$:$C_7$ ratio was not investigated.

These results show that the level of $C_6$ material that can be incorporated to the most beneficial effect in the starting alcohol mix depends on the proportions of $C_7$ and $C_8$ alcohols present.

EXAMPLE VIII

A similar investigation was carried out using compositions containing 12% by weight of dialkyl sulphosuccinate and 12% by weight of alkyl ether sulphate (containing ethanol).

| | $C_6$ | $C_7$ | $C_8$ | Urea (wt %) | Cloud point (°C.) | Viscosity (cp) | Plates test 5° H | Plates test 24° H |
|---|---|---|---|---|---|---|---|---|
| 14 | 10 | 30 | 60 | 5 | 8 | 508 | 39 | 33 |
| 15 | 25 | 25 | 50 | 5 | −6 | 282 | 36 | 34 |
| K | 50 | 16.7 | 33.3 | 5 | −5 | 88 | 28 | 31 |
| 7 | — | 50 | 50 | 5 | 1 | 559 | 38 | 36 |
| 16 | 20 | 40 | 40 | 5 | −5 | 259 | 35 | 35 |
| L | 50 | 25 | 25 | 5 | <−10 | 86 | 27 | 25 |
| 17 | 10 | 60 | 30 | 5 | −8 | 247 | 38 | 36 |
| 18 | 25 | 50 | 25 | 5 | −7 | 145 | 36 | 33 |

A similar picture emerges to that obtained from Example VII. Inclusion of 50 mole % of $C_6$ material (calculated on the starting alcohol mix) gives low viscosities and poor performance at $C_8$:$C_7$ ratios of both 2:1 and 1:1.

EXAMPLE IX

In this Example, $C_6/C_7/C_8$ and $C_7/C_8$ dialkyl sulphosuccinate mixes were compared with a $C_6/C_8$ mix as disclosed in GB 2 108 520 (Unilever). All mixes were based on linear alcohols.

The compositions contained 16% dialkyl sulphosuccinate and 8% alkyl ether sulphate (ethanol-free).

| | $C_6$ | $C_7$ | $C_8$ | Urea (wt %) | Cloud point (°C.) | Viscosity (cp) | Plate test 5° H | Plate test ° H |
|---|---|---|---|---|---|---|---|---|
| M | 50 | — | 50 | 12 | −8 | 139 | 38 | 32 |
| 10 | 25 | 25 | 50 | 12 | 10 | 350 | 43 | 36 |
| | | | | 14 | −6 | | | |
| 4 | — | 50 | 50 | 12 | 19 | 501 | 55 | 37 |
| | | | | 16 | −5 | | | |
| J | 50 | 25 | 25 | 12 | <−10 | 101 | 26 | 26 |

Composition M, which is as disclosed in GB 2 108 520, had good performance in both water hardnesses, a low cloud point and hydrotrope requirement, but a rather low viscosity. Replacement of half the $C_6$ alcohol by $C_7$ alcohol (Composition 10) improved the performance from good to excellent and improved the viscosity, but at the cost of a slightly greater hydrotrope requirement. Replacement of all the $C_6$ alcohol by $C_7$ alcohol had a similar but larger effect.

Replacement of half the $C_8$ alcohol by $C_6$ alcohol (Composition J) caused the performance and viscosity to fall to an unacceptable level.

EXAMPLE X

Example IX was repeated at a dialkyl sulphosuccinate to alkyl ether sulphate ratio of 1:1 (12% by weight of each), using ethanol-containing alkyl ether sulphate.

| | $C_6$ | $C_7$ | $C_8$ | Cloud point (°C.) | Viscosity (cp) | Plates test 5° H | Plates test 24° H |
|---|---|---|---|---|---|---|---|
| N | 50 | — | 50 | −5 | 111 | 35 | 32 |
| 15 | 25 | 25 | 50 | −6 | 282 | 36 | 34 |
| 7 | — | 50 | 50 | 5 | 559 | 38 | 36 |
| P | 50 | 25 | 25 | <−10 | 86 | 27 | 25 |

Similar trends were observed, although, as expected, differences in performance were less marked at this lower total dialkyl sulphosuccinate level.

EXAMPLE XI

A similar performance comparison to that of Examples IX and X was conducted using compositions containing a ternary detergent-active system of dialkyl sulphosuccinate (10% by weight), alkylbenzene sulphonate (10% by weight) and alkyl ether sulphate (10% by weight). The alkylbenzene sulphonate was Dob (Trade Mark) 102 ex Shell, a linear $C_{10}$–$C_{12}$ alkylbenzene sulphonate.

| | $C_6$ | $C_7$ | $C_8$ | Plates test 5° H | Plates test 24° H |
|---|---|---|---|---|---|
| Q | 50 | — | 50 | 38 | 34 |
| 19 | — | 50 | 50 | 51 | 43 |

It will be seen that replacement of $C_6$ material by $C_7$ material in the dialkyl sulphosuccinate improved the performance in both water hardnesses, the substantial improvement in hard water being especially surprising.

EXAMPLE XII $C_6/C_8$ and $C_6/C_7/C_8$ dialkyl sulphosuccinate mixes were compared in compositions containing dialkyl sulphosuccinate, alkylbenzene sulphonate and alkyl ether sulphate (ethanol-free) in slightly different proportions (12%, 8% and 8% by weight respectively).

| | $C_6$ | $C_7$ | $C_8$ | Urea (wt %) | Cloud point (°C.) | Viscosity (cp) | Plates test 5° H | Plates test 24° H |
|---|---|---|---|---|---|---|---|---|
| R | 50 | — | 50 | 12 | <−10 | 395 | 43 | 33 |
| 20 | 10 | 60 | 30 | 12 | <−10 | 725 | 46 | 38 |

Composition 20, incorporating $C_7$ material mainly in replacement of $C_6$ material, gave better performance in both water hardnesses, had a higher viscosity, and had equally good cloud point and hydrotrope requirement.

EXAMPLE XIII

The two dialkyl sulphosuccinate mixes used in Example XII were compared again, using a different ternary detergent-active system: dialkyl sulphosuccinate (13.33% by weight), ethanol-free alkyl ether sulphate (6.67% by weight) and lauric diethanolamide (4% by weight). The last-mentioned ingredient was Ninol (Trade Mark) P 621 ex Stepan Chemical Co.

| | $C_6$ | $C_7$ | $C_8$ | Urea (wt %) | Cloud point (°C.) | Viscosity (cp) | Plates test 5° H | Plates test 24° H |
|---|---|---|---|---|---|---|---|---|
| 5 | 50 | — | 50 | 12 | <−10 | 213 | 39 | 34 |
| 21 | 10 | 60 | 30 | 12 | <−10 | 512 | 44 | 39 |

The introduction of $C_7$ material produced a similar improvement to that observed in Example XII.

EXAMPLE XIV

Some formulations containing a relatively low (14%) total level of active detergent were prepared using a $C_7/C_8$ dialkyl sulphosuccinate (derived from 50 mole % each of linear $C_7$ and $C_8$ alcohols), alkyl ether sulphate, and coconut diethanolamide (Empilan (Trade Mark) CDE ex Albright & Wilson). The alkyl ether sulphate used in this Example was ethanol-free.

The compositions were stable but viscosities were low; these could be improved by the addition of low levels of magnesium chloride, as described and claimed in our British Patent Application No. 82 32687 filed on Nov. 16, 1982.

| | 22 | 23 | 24 | 25 |
|---|---|---|---|---|
| Dialkyl sulphosuccinate | 8 | 8 | 6 | 6 |
| Alkyl ether sulphate | 4 | 4 | 6 | 6 |
| Coconut diethanolamide | 2 | 2 | 2 | 2 |
| Urea | 10 | 10 | — | — |
| $MgCl_2.6H_2O$ | — | 0.5 | — | 0.5 |
| Viscosity (cp) | 24 | 150 | 25 | 274 |
| Cloud point (°C.) | <−10 | <−10 | −2 | 2.5 |

I claim:

1. A detergent-active, statistically distributed, dialkyl sulphosuccinate mixture derived from esterification of unesterified precursor with a mixture of straight-chain and/or 2-branched aliphatic alcohols, said alcohol radical chains comprising:

(a) 25 to 75 mole % of $C_8$ alcohol, (b) 15 to 75 mole % of $C_7$ alcohol, and (c) 0 to 35 mole % of $C_6$ alcohol, said alcohol mix being substantially free of material of other chain lengths, said mixture being substantially free of dialkyl sulphosuccinates having alcohol radicals of other than $C_6$ to $C_8$ chain lengths.

2. The dialkyl sulphosuccinate mixture of claim 1, wherein the $C_6$, $C_7$ and $C_8$ alcohols are primary alcohols.

3. The dialkyl sulphosuccinate mixture of claim 1, which is derived from an alcohol mixture containing at most 25 mole % of $C_6$ alcohol.

4. The dialkyl sulphosuccinate mixture of claim 1, which is derived from an alcohol mixture containing $C_7$ and $C_8$ alcohols in a mole ratio of from 2:1 to 1:2.

5. The dialkyl sulphosuccinate mixture of claim 4, which is derived from an alcohol mixture containing substantially equimolar amounts of $C_7$ and $C_8$ alcohols.

6. The dialkyl sulphosuccinate mixture of claim 1, wherein the $C_8$ alcohol of the alcohol mixture consists wholly or predominantly of n-octanol.

7. The dialkyl sulphosuccinate mixture of claim 1, wherein the $C_7$ alcohol of the alcohol mixture consists wholly or predominantly of n-heptanol.

8. A foaming detergent composition comprising at least 2% by weight of a statistically distributed dialkyl sulphosuccinate mixture derived from esterification of unesterified precursor with a mixture of straight-chain and/or 2-branched aliphatic alcohols, said alcohol radical chains comprising:

(a) 25 to 75 mole % of $C_8$ alcohol, (b) 15 to 75 mole % of $C_7$ alcohol, and (c) 0 to 35 mole % of $C_6$ alcohol, said alcohol mix being substantially free of material of other chain lengths, said mixture being substantially free of dialkyl sulphosuccinates having alcohol radicals of other than $C_6$ to $C_8$ chain lengths.

9. The detergent composition of claim 8, wherein the dialkyl sulphosuccinate mixture constitutes at least 5% of the total composition.

10. The detergent composition of claim 9, wherein the dialkyl sulphosuccinate mixture constitutes at least 10% of the total composition.

11. The detergent composition of claim 8, which further comprises at least one detergent-active material selected from alkylbenzene sulphonates, secondary alkane sulphonates, alkyl sulphates, alkyl ether sulphates, polyethoxylated nonionic detergents, and fatty acid di($C_2$–$C_3$) alkanolamides.

12. The detergent composition of claim 11, which further comprises a $C_{10}$ to $C_{18}$ alkyl polyethoxy sulphate having an average degree of ethoxylation of from 1 to 12.

13. The detergent composition of claim 11, which further comprises a $C_{11}$ to $C_{15}$ alkyl polyethoxy sulphate having an average degree of ethoxylation of from 1 to 8.

14. The detergent composition of claim 11, which further comprises a $C_{11}$ to $C_{15}$ alkyl polyethoxy sulphate containing less than 20% of material of chain length of $C_{14}$ and above and having an average degree of ethoyxlation of from 1 to 8.

15. The detergent composition of claim 8, which is a liquid.

16. The detergent composition of claim 15, which is in the form of an aqueous composition containing a total of from 2 to 60% by weight of detergent-active material.

17. The detergent composition of claim 15, which is in the form of a clear homogeneous aqueous solution.

18. The detergent composition of claim 15, which also includes a viscosity and clarity control system comprising at least one material selected from lower alkanols, urea, and lower alkylbenzene sulphonates.

* * * * *